US006592216B2

(12) United States Patent
Slenes et al.

(10) Patent No.: US 6,592,216 B2
(45) Date of Patent: Jul. 15, 2003

(54) INK JET PRINT HEAD ACOUSTIC FILTERS

(75) Inventors: Chad J. Slenes, Sherwood, OR (US); Christine M. Greiser, Lake Oswego, OR (US); David J. Finnie, Beaverton, OR (US); John M. Brookfield, Woodburn, OR (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/891,776

(22) Filed: Jun. 25, 2001

(65) Prior Publication Data

US 2002/0196319 A1 Dec. 26, 2002

(51) Int. Cl.[7] ..... B41J 2/17
(52) U.S. Cl. ..... 347/94
(58) Field of Search ..... 347/94, 63, 70, 347/71

(56) References Cited

U.S. PATENT DOCUMENTS 5,963,234 A * 10/1999 Miyazawa et al. ..... 347/70
6,260,963 B1 * 7/2001 Reistad et al. ..... 347/94

FOREIGN PATENT DOCUMENTS

| | | |
|---|---|---|
| DE | 10030871 A | 3/2001 |
| EP | 0 649 745 A | 4/1995 |
| EP | 0 726 151 A | 8/1996 |
| JP | 60008074 A | 1/1985 |
| JP | 200203017 A | 7/2000 |

* cited by examiner

*Primary Examiner*—Michael Nghiem
(74) *Attorney, Agent, or Firm*—Philip T. Virga

(57) ABSTRACT

Acoustic filters for use in an ink jet print head are disclosed. The ink jet print head defines a plurality of operating plates held together in a superimposed relationship forming an ink jet print head defining a plurality of ink manifolds, ink inlets, ink drop-forming orifices and a plurality of acoustic filters. The acoustic filters are a plurality of compliant areas connected by an acoustic filter constriction aperture and a plurality of separate compliant areas all connected to ink manifolds for suppressing unwanted frequencies during print modes.

9 Claims, 18 Drawing Sheets

INK JET PRINT HEAD ACOUSTIC FILTERS

This invention relates to drop-on-demand ink jet print heads and in particular to a high-performance, print media-width plate stacked print head incorporating multiple arrays of ink jets that are optimized for purgability, jetting uniformity, and high drop-ejection rate performance. More specifically, the invention is directed to a plurality of acoustic filters formed and imbedded in the ink jet head to suppress unwanted frequencies that may arise during different print modes.

There are well-known apparatuses and methods for implementing multiple-orifice drop-on-demand ink jet print heads. In general, each ink jet of a multiple-orifice drop-on-demand ink jet array print head operates by the displacement of ink in an ink pressure chamber and the subsequent ejection of ink droplets from an associated orifice. Ink is supplied from a common ink supply manifold through an ink inlet to the ink pressure chamber. A driver mechanism is used to displace the ink in the ink pressure chamber. The driver mechanism typically includes a piezoelectric transducer bonded to a thin diaphragm. When a voltage is applied to the transducer, it displaces ink in the ink pressure chamber, causing the ink to flow through the inlet from the ink manifold to the ink pressure chamber and through an outlet and passageway to the orifice.

It is desirable to employ a geometry that permits the multiple orifices to be positioned in a densely packed array. Suitably arranging the manifolds, inlets, pressure chambers, and the fluidic couplings of the chambers to associated orifices is not a straightforward task, especially when compact ink jet array print heads are sought. Incorrect design choices, even in minor features, can cause nonuniform jetting performance. Uniform jetting performance is generally accomplished by making the various features of each ink jet array channel substantially identical. Uniform jetting also depends on each channel being free of air, contaminants, and internally generated gas bubbles that can form in the print head and interfere with jetting performance. Therefore, the various features of the multiple-orifice print head must also be designed for effective purging. Also described is the effect of pressure chamber resonances on jetting uniformity and the use of dummy channels and compliant wall structures to reduce reflected wave-induced cross-talk in a 36-orifice ink jet print head.

Prior art print heads are typically constructed of laminated plates that together form associated arrays of ink manifolds, diaphragms, ink pressure chambers, ink inlets, offset channels, and orifices. Particular plates also form black, yellow, magenta, and cyan ink manifolds that are distributed elevationally above and below the other internal ink jet features. In particular, the elevationally lower manifolds are connected to the upper manifolds by ink communication channels. Moreover, the tapering and sizing of the manifolds and other internal ink jet features minimizes cross-talk and resonance-induced jetting nonuniformities. Additionally, various print modes result in unwanted frequencies that can span several orders of magnitude. These frequencies result in print artifacts normal to the direction of printing. Also, the highest unwanted frequency causing such affect is induced in the system is the actuation frequency of the single jets.

Accordingly, this invention provides acoustic filters for use in an ink jet print head. The ink jet print head defines a plurality of operating plates held together in a superimposed relationship forming an ink jet print head defining a plurality of ink manifolds, ink inlets, ink drop-forming orifices and a plurality of acoustic filters. The acoustic filters are a plurality of compliant areas connected by an acoustic filter constriction aperture and a plurality of separate compliant areas all connected to ink manifolds for suppressing unwanted frequencies during print modes.

Additional objects and advantages of this invention will be apparent from the following detailed description of a preferred embodiment thereof that proceeds with reference to the accompanying drawings.

DETAILED DESCRIPTION

Figure 1:
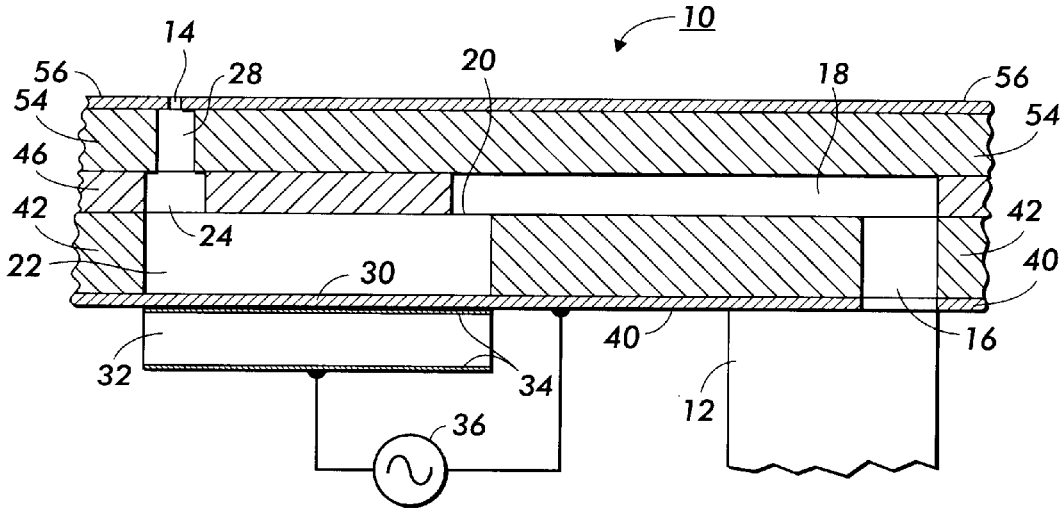
FIG. 1 PRIOR ART
FIG. 1 is an enlarged diagrammatical cross-sectional view of an exemplary prior art piezoelectric transducer driven ink jet showing a plate-stacking arrangement of internal features thereof suitable for use in an ink jet array print head of this invention.

FIG. 1 cross-sectionally shows an exemplary prior art single ink jet 10 that is suitable for use in a high-resolution color ink jet array print head of this invention. Ink jet 10 has a body that defines an ink manifold 12 through which ink is delivered to the ink jet print head. The body also defines an ink drop-forming orifice 14 together with an ink flow path from ink manifold 12 to orifice 14. In general, the ink jet print head preferably includes an array of orifices 14 that are closely spaced relative to one another for use in ejecting drops of ink onto an image-receiving medium (not shown), such as a sheet of paper or a transfer drum.

A typical ink jet print head has at least four manifolds for receiving black ("K"), cyan ("C"), magenta ("M"), and yellow ("Y") ink for use in black plus subtractive three-color printing. (Hereafter, reference numerals pertaining to ink jet features carrying a particular ink color will further include an appropriate identifying suffix, e.g., manifold 12K, and features will be referred to collectively or generally without a suffix, e.g., manifold 12.) However, the number of such manifolds may be varied depending upon whether a printer is designed to print solely in black ink or with less than a full range of color. Ink flows from manifold 12 through an inlet port 16, an inlet channel 18, a pressure chamber port 20 and into an ink pressure chamber 22. Ink leaves pressure chamber 22 by way of an outlet port 24 and flows through an outlet channel 28 to nozzle 14, from which ink drops are ejected. Alternatively, an offset channel may be added between pressure chamber 22 and orifice 14 to suit particular ink jet applications.

Ink pressure chamber 22 is bounded on one side by a flexible diaphragm 30. An electromechanical transducer 32, such as a piezoelectric transducer, is secured to diaphragm 30 by an appropriate adhesive and overlays ink pressure chamber 22. In a conventional manner, transducer 32 has metal film layers 34 to which an electronic transducer driver 36 is electrically connected. Although other forms of transducers may be used, transducer 32 is operated in its bending mode such that when a voltage is applied across metal film layers 34, transducer 32 attempts to change its dimensions. However, because it is securely and rigidly bonded to the diaphragm, transducer 32 bends, deforming diaphragm 30, and thereby displacing ink in ink pressure chamber 22, causing the outward flow of ink through outlet port 24 and outlet channel 28 to orifice 14. Refill of ink pressure chamber 22 following the ejection of an ink drop is augmented by the orifice meniscus, reverse bending of transducer 32 and the concomitant movement of diaphragm 30.

To facilitate manufacture of an ink jet array print head usable with the present invention, ink jet 10 is preferably formed of multiple laminated plates or sheets, such as of stainless steel. These sheets are stacked in a superimposed relationship. In the illustrated FIG. 1 embodiment of this invention, these sheets or plates include a diaphragm plate 40, which forms diaphragm 30 and a portion of manifold 12; an ink pressure chamber plate 42, which defines ink pressure chamber 22 and a portion of manifold 12; an inlet channel plate 46, which defines inlet channel 18 and outlet port 24; an outlet plate 54, which defines outlet channel 28; and an orifice plate 56, which defines orifice 14 of ink jet 10.

More or fewer plates than those illustrated may be used to define the various ink flow passageways, manifolds, and pressure chambers of the ink jet print head. For example, multiple plates may be used to define an ink pressure chamber instead of the single plate illustrated in FIG. 1. Also, not all of the various features need be in separate sheets or layers of metal. For example, patterns in the photoresist that are used as templates for chemically etching the metal (if chemical etching is used in manufacturing) could be different on each side of a metal sheet. Thus, as a more specific example; the pattern for the ink inlet passage could-be placed on one side of the metal sheet while the pattern for the pressure chamber could be placed on the other side and in registration front-to-back. Thus, with carefully controlled etching, separate ink inlet passage- and pressure chamber-containing layers could be combined into one common layer.

Figure 2:
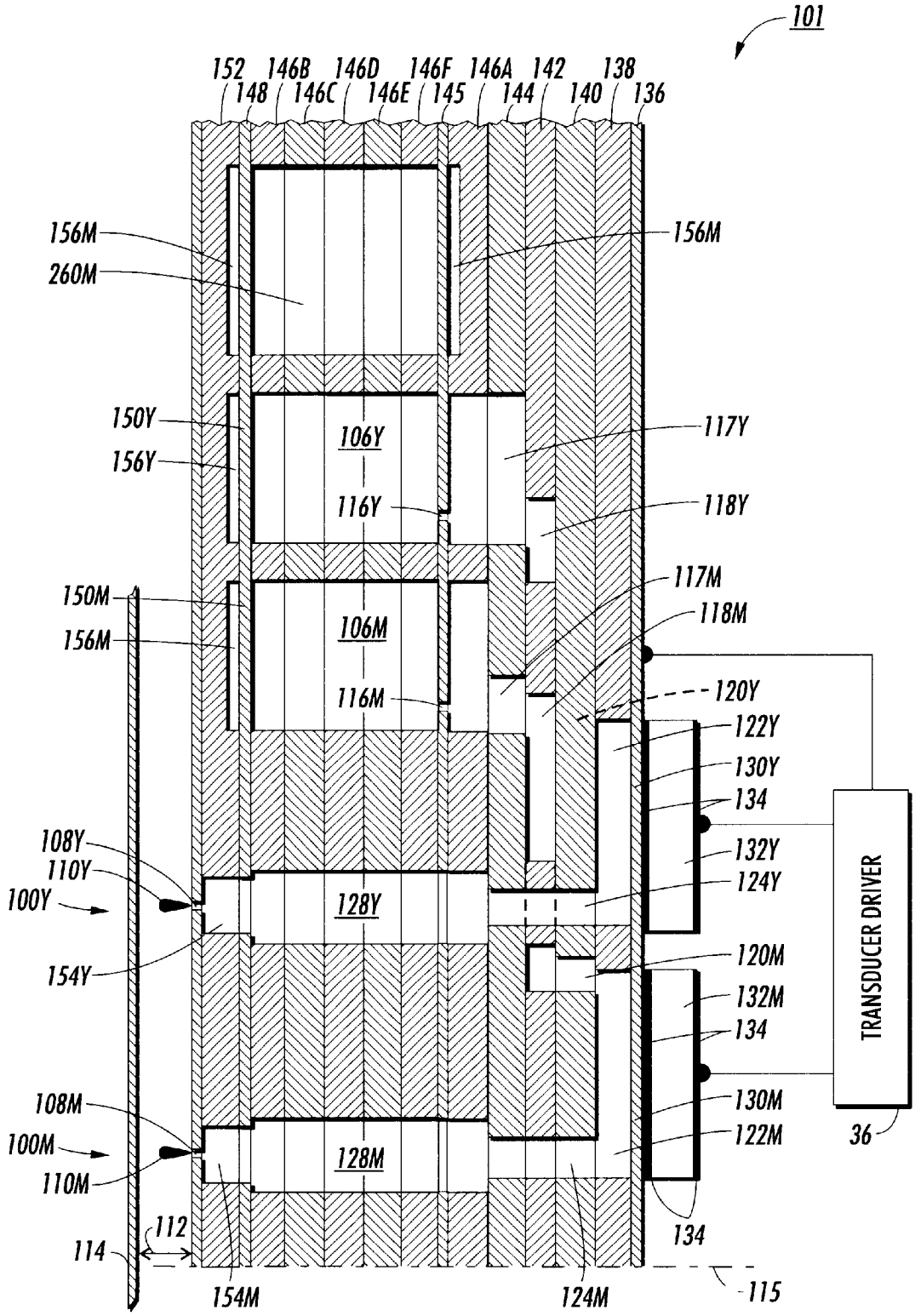
FIG. 2 is an enlarged diagrammatical cross-sectional view of an ink jet array print head of this invention showing a plate-stacking arrangement of two piezoelectric transducer-driven ink jets thereof suitable for ejecting different colored ink drops.

FIG. 2 cross-sectionally shows a preferred plate stack arrangement for constructing ink jets 100Y and 100M that are a representative pair employed in a high-resolution, color ink jet array print head 101 of this invention. Ink jets 100 are formed in a body that defines ink inlet ports 102Y and 102M, ink feed channels 104Y and 104M, and ink manifolds 106Y and 106M through which ink is delivered to respective ink jets 100Y and 100M. The body also defines ink drop-forming orifices 108Y and 108M from which ink drops 110Y and 110M are ejected across a distance 112 toward an image-receiving medium 114. In general, preferred ink jet array print head 101 includes four linear arrays of ink jets 100Y, 100M, 100C, and 100K that are closely spaced relative to one another for use in ejecting patterns of ink drops 110 toward image-receiving medium 114 in which black, cyan, magenta, and yellow ink are used in black plus subtractive three-color printing.

Using any ink color as an example, ink flows from manifolds 106 through inlet filters 116, inlet ports 117, inlet channels 118, and pressure chamber ports 120 into ink pressure chambers 122. Ink leaves pressure chambers 122 by way of outlet ports 124 and flows through channels 128 to orifices 108, from which ink drops 110 are ejected.

Ink pressure chambers 122 are bounded on one side by flexible diaphragms 130. Transducers 132 are secured to diaphragms 130 by an appropriate adhesive to overlay respective ink pressure chambers 122. Transducers 132-have metal film layers 134 to which electronic transducer driver 36 is electrically connected wherein the transducers 132 are preferably operated in a bending mode and are driven by electrical drive signals. To facilitate manufacture of preferred ink jet print head 101, ink jets 100 are formed of multiple laminated plates or sheets, such as of stainless steel, that are stacked in, a superimposed relationship. Print head 101 of this invention is designed so that layer-to-layer alignment is not critical. That is, typical tolerances that can be held in a chemical etching process are adequate. The various plates forming ink jet print head 101 may be aligned and bonded in any suitable manner, including by the use of suitable mechanical fasteners.

In the illustrated FIG. 2 embodiment of the present invention, the plates include a diaphragm plate 136 that forms diaphragms 130 and portions of ink inlet ports 102; a body plate 138 that forms pressure chambers 122, portions of ink inlet ports 102, and provides a rigid backing for diaphragm plate 136; a separator plate 140 that forms pressure chamber ports 120, and portions of ink inlet ports 102 and outlet ports 124; an inlet channel plate 142 that forms inlet channels 118, and portions of ink inlet ports 102 and outlet ports 124; a separator plate 144 that forms inlet ports 117 and portions of ink inlet ports 102, outlet ports 124 and manifolds 106; a filter plate 145 that forms ink filters 116 and portions of ink inlet ports 102 and outlet ports 124; six manifold plates 146A through 146F that form ink manifolds 106, boost bottle filters 260, acoustic filters 254, ink feed channels 104, outlet channels 128, and the remaining portions of ink inlet ports 102; a wall plate 148 that forms compliant walls 150 for respective ink manifolds 106, and a portion of the transition regions between respective outlet channels 128 and orifices 108; an orifice brace plate 152 that forms another portion of the transition regions 154 and air chambers 156 behind respective compliant walls 150; and an orifice plate 158 that forms orifices 108.

To ensure jetting uniformity, all of ink jets 100 must operate substantially identically. This is achieved by constructing the ink jets such that all related features have substantially identical fluidic properties (inlet length and cross-sectional area, outlet length and cross-sectional areas and orifice size) and substantially identical transducer coupling efficiency (pressure chamber, diaphragm, and transducer dimensions).

Figure 3:
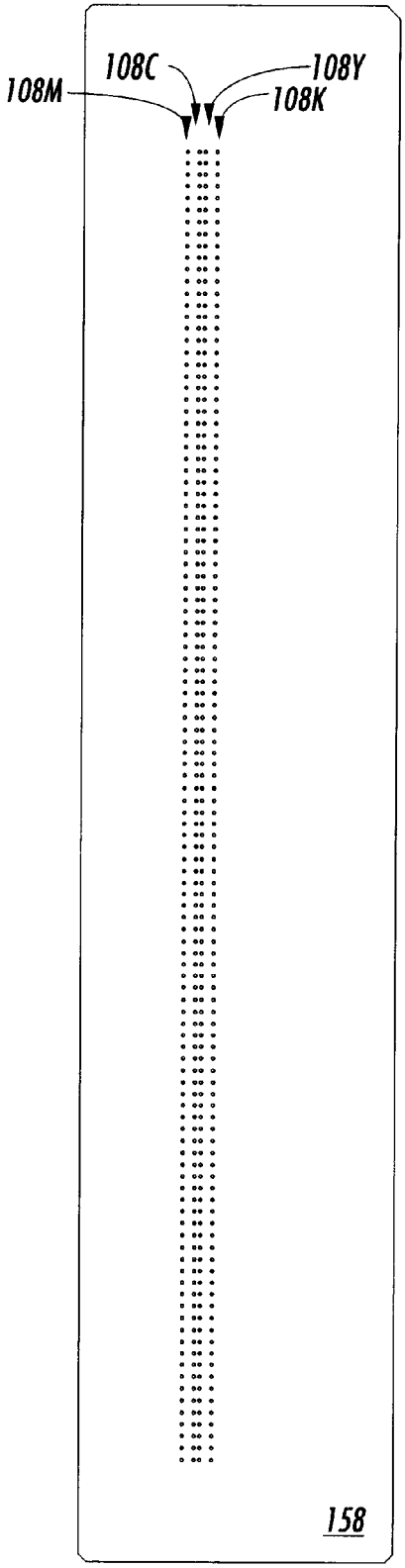
FIG. 3 is a plan view showing a preferred orifice plate of this invention.

FIGS. 3–17 show the plates that, when laminated together, form the print head 101 defining the acoustic filters of this invention as will be more fully described below. In particular, FIG. 3 shows orifice plate 158, through which are formed openings for orifices 108.

Figure 4:
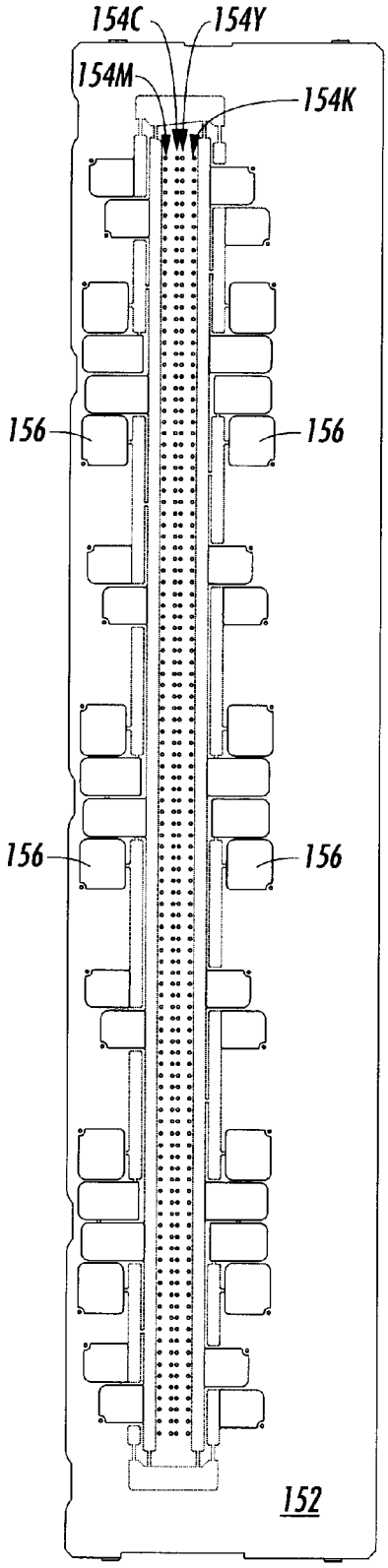
FIG. 4 is a plan view showing a preferred orifice brace plate of this invention.

FIG. 4 shows orifice brace plate 152, through which are openings for forming portions of transition regions 154. Features are present which, when combined with wall plate 148, create air chambers 156.

Figure 5:
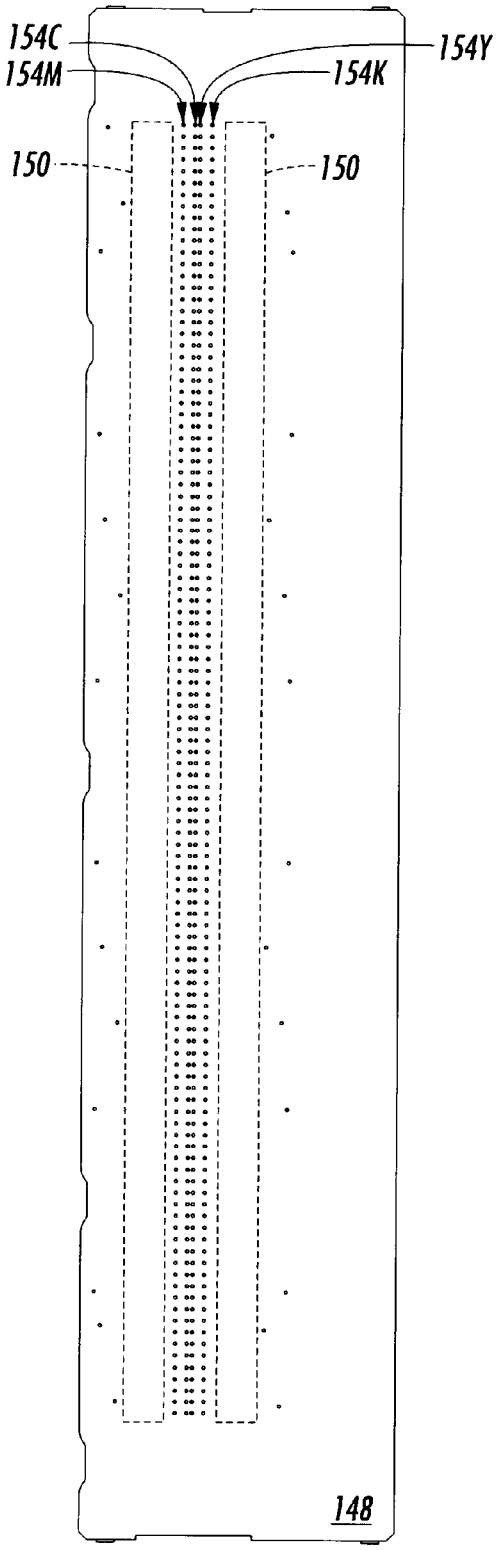
FIG. 5 is a plan view showing a preferred compliant wall plate of this invention.

FIG. 5 shows wall plate 148, through which are openings for forming portions of transition regions 154. Compliant walls 150 are inherently formed in the plate material in the regions shown outlined in dashed lines.

Figure 6:
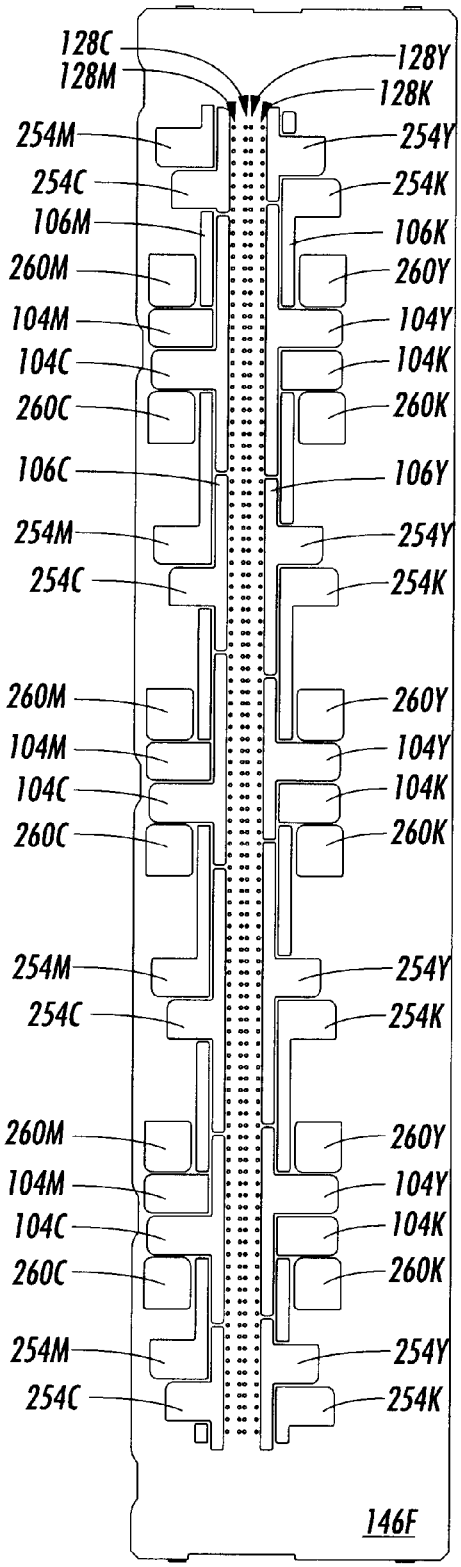
FIGS. 6–10 and 12 are plan views showing a set of preferred manifold plates forming the acoustic filters of this invention.

FIG. 6 shows manifold plate 146F, through which openings for forming portions of the first set of acoustic filters 254, the second filter 260 (hereinafter referred to as a boost bottle filter) connected to manifolds 106 and ink feed channels 104.

Figure 7:
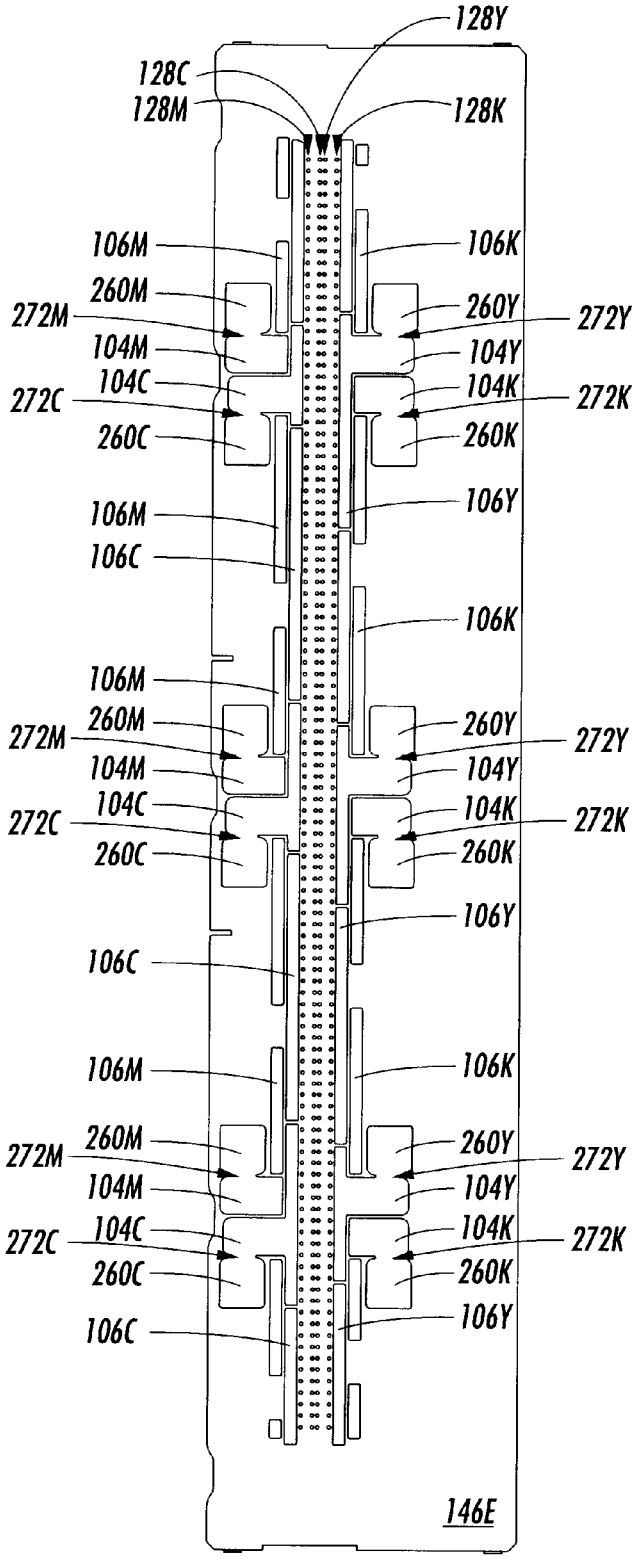

FIG. 7 shows manifold plate 146E, through which openings for forming portions of the first set of acoustic filters 254, the second filter or boost bottle filter 260 connected to manifolds 106 and ink feed channels 104. Also a portion of an aperture 272 is formed between the boost bottle 260 and ink feed-channel 104 forming an acoustic filter constriction for use in the present invention, which use will be more fully described below.

Figure 8:
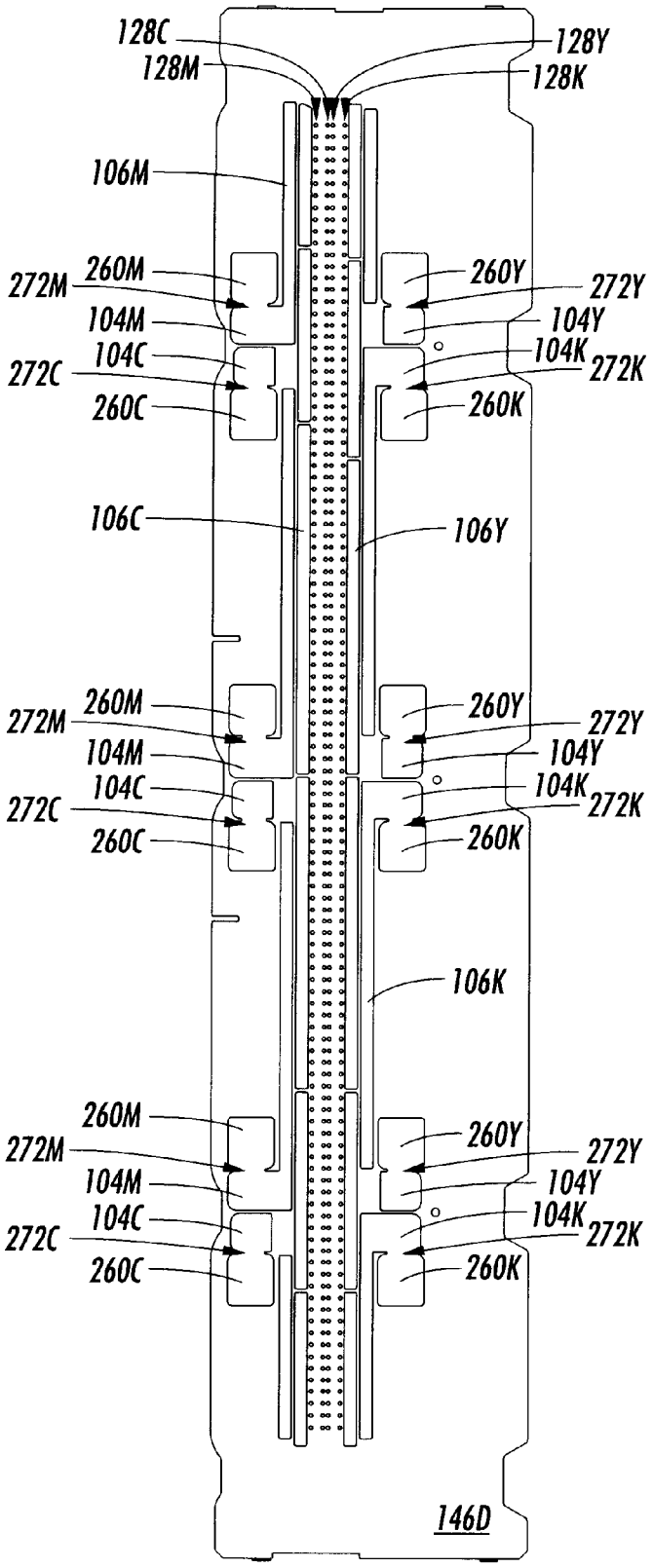

FIG. 8 shows manifold plate 146D, through which openings for forming portions of the first set of acoustic filters 254, the second filter or boost bottle filter 260 with acoustic filter constriction aperture 272 and ink feed channels 104 connected to manifolds 106.

Figure 9:
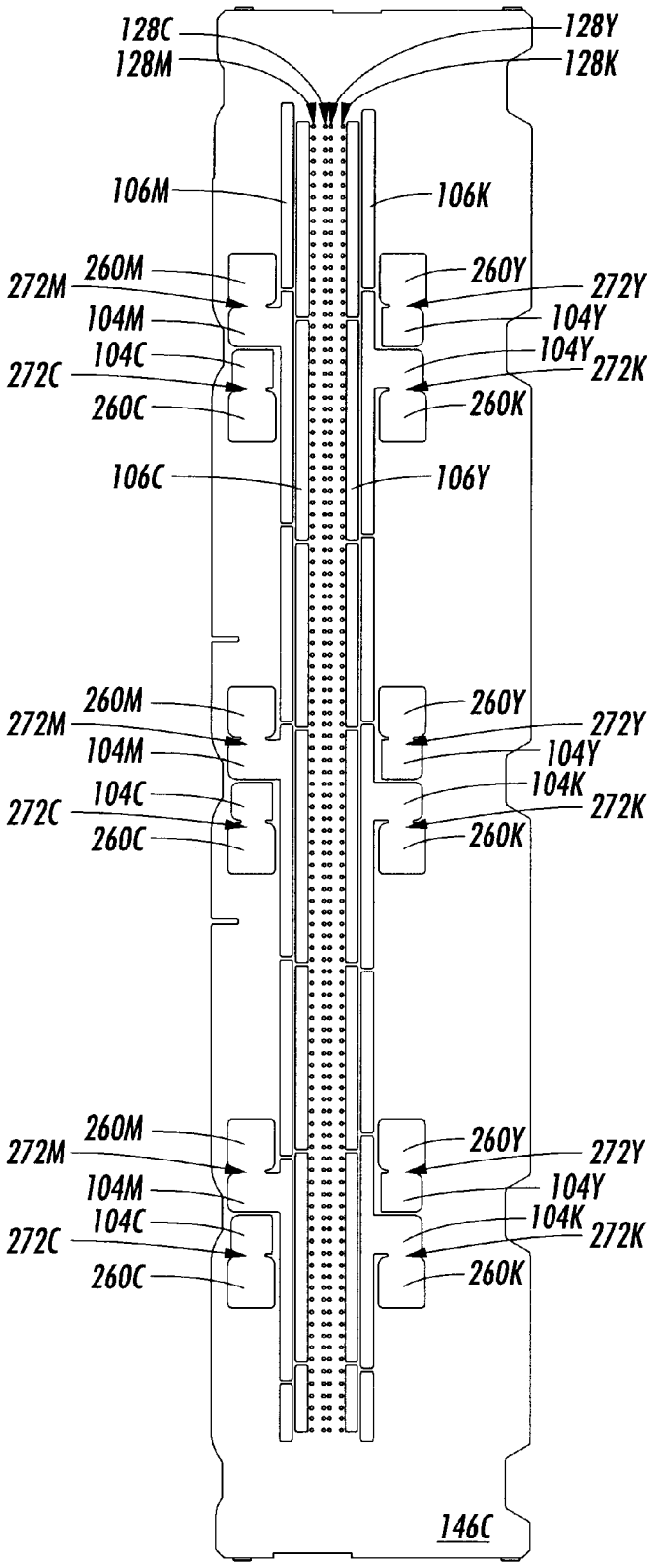

FIG. 9 shows manifold plate 146C, through which openings for forming portions of the first set of acoustic filters 254, manifolds 106, the second filter or boost bottle filter 260 with acoustic filter constriction aperture 272 and ink feed channels 104.

Figure 10:
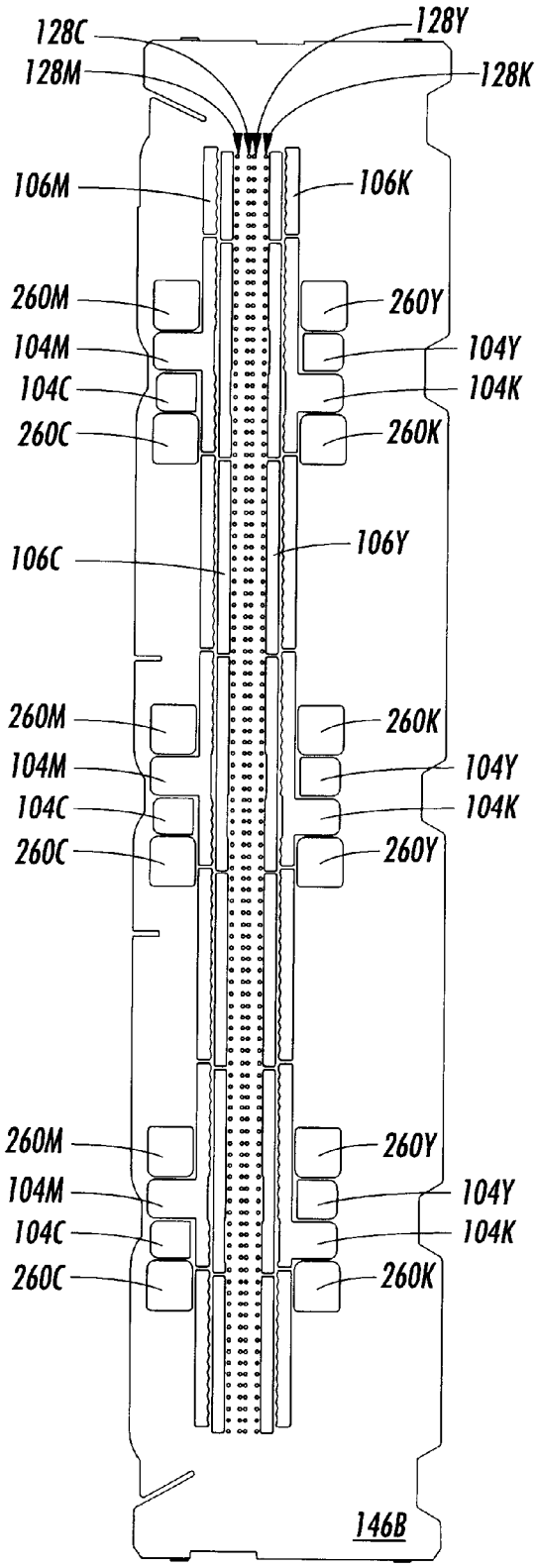

FIG. 10 shows manifold plate 146B, through which openings for forming portions of the first set of acoustic filters 254, the second filter or boost bottle filter 260 connected to manifolds 106 and ink feed channels 104.

Figure 11:
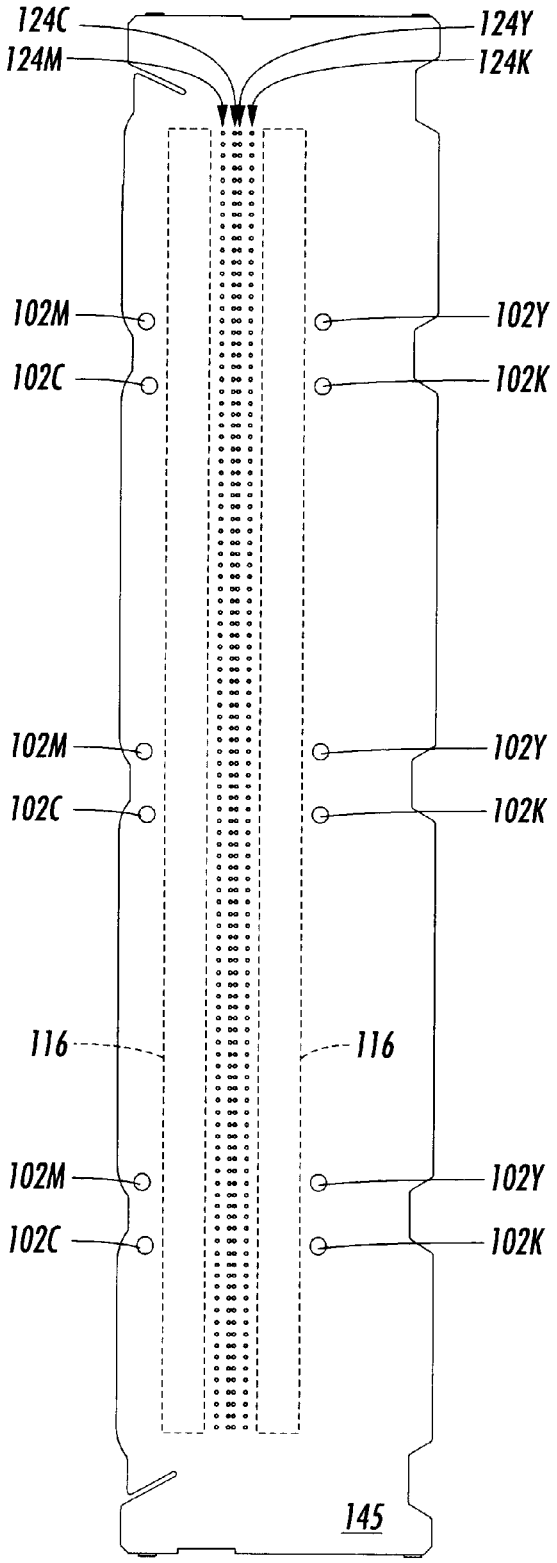
FIG. 11 is a plan view showing a preferred filter plate of this invention.

FIG. 11 shows filter plate 145, through which are openings for forming ink filters 116, portions of ink inlet ports 102, and portions of outlet channels 128.

Figure 12:
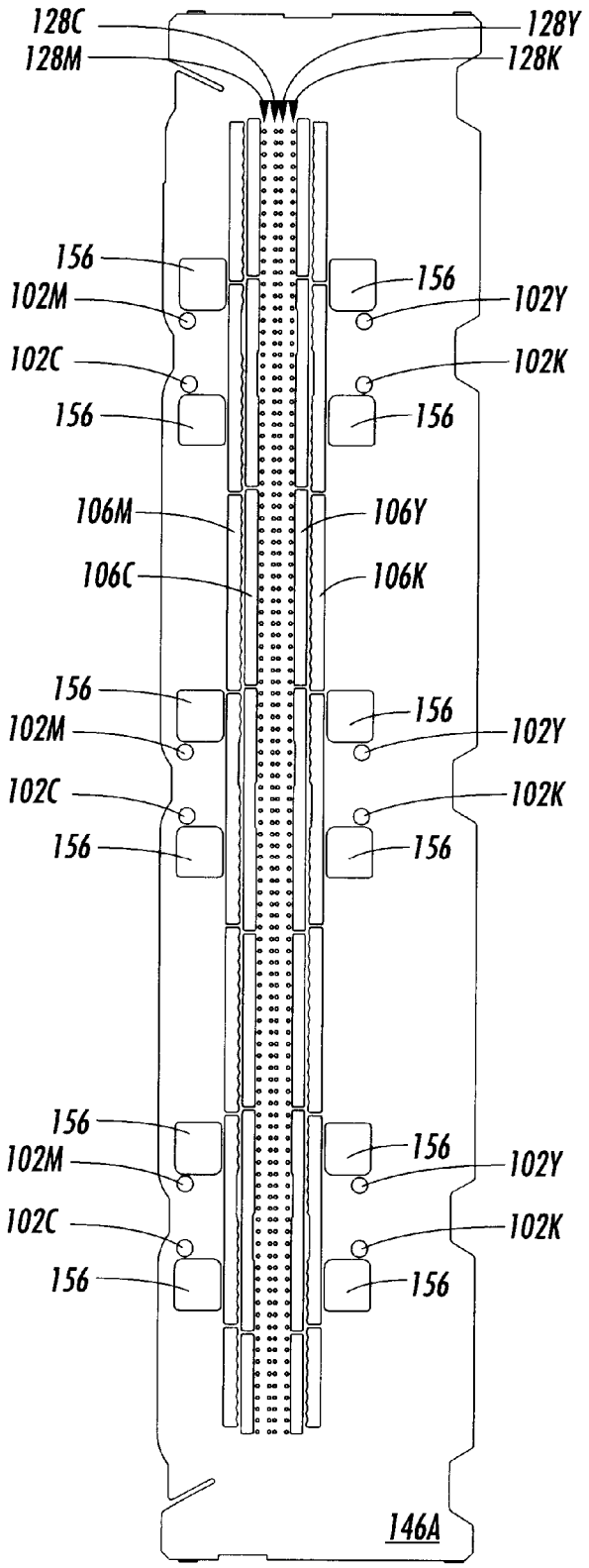

FIG. 12 shows manifold plate 146A, through which are openings for forming portions of outlet ports 124 and portions of ink inlet ports 102. Features are present which, when combined with filter plate 145, create air chambers 156.

Figure 13:
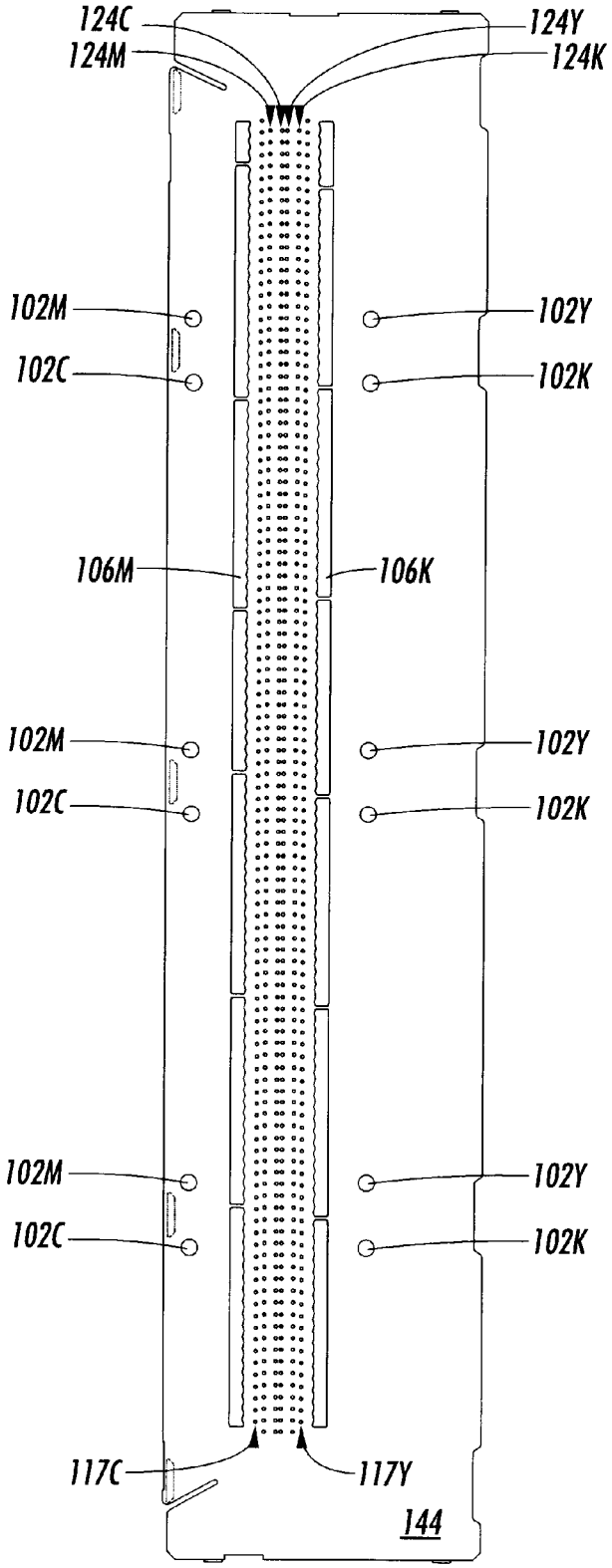
FIG. 13 is a plan view showing a preferred separator plate of this invention.

FIG. 13 shows separator plate 144, through which are openings for forming portions of outlet ports 124, portions of ink inlet ports 102 and manifolds 106.

Figure 14:
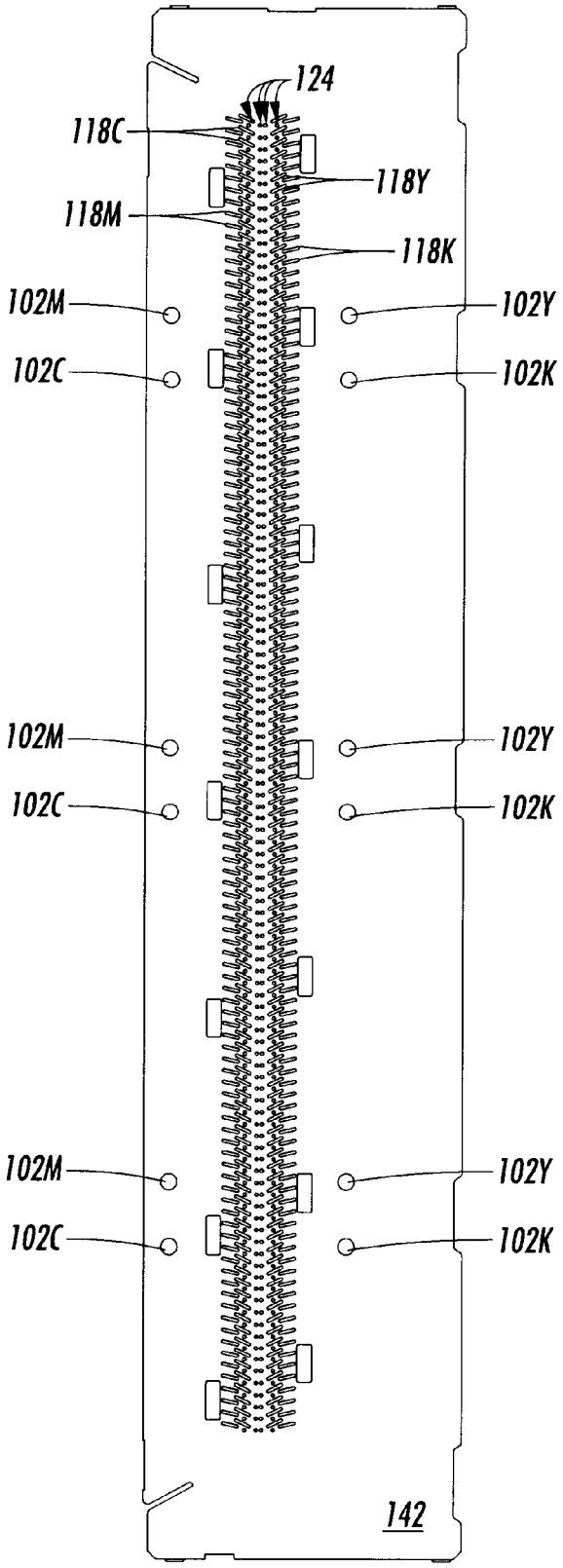
FIG. 14 is a plan view showing a preferred inlet channel plate of this invention.

FIG. 14 shows inlet channel plate 142, through which are openings for forming portions of inlet channels 118 and portions of ink inlet ports 102.

Figure 15:
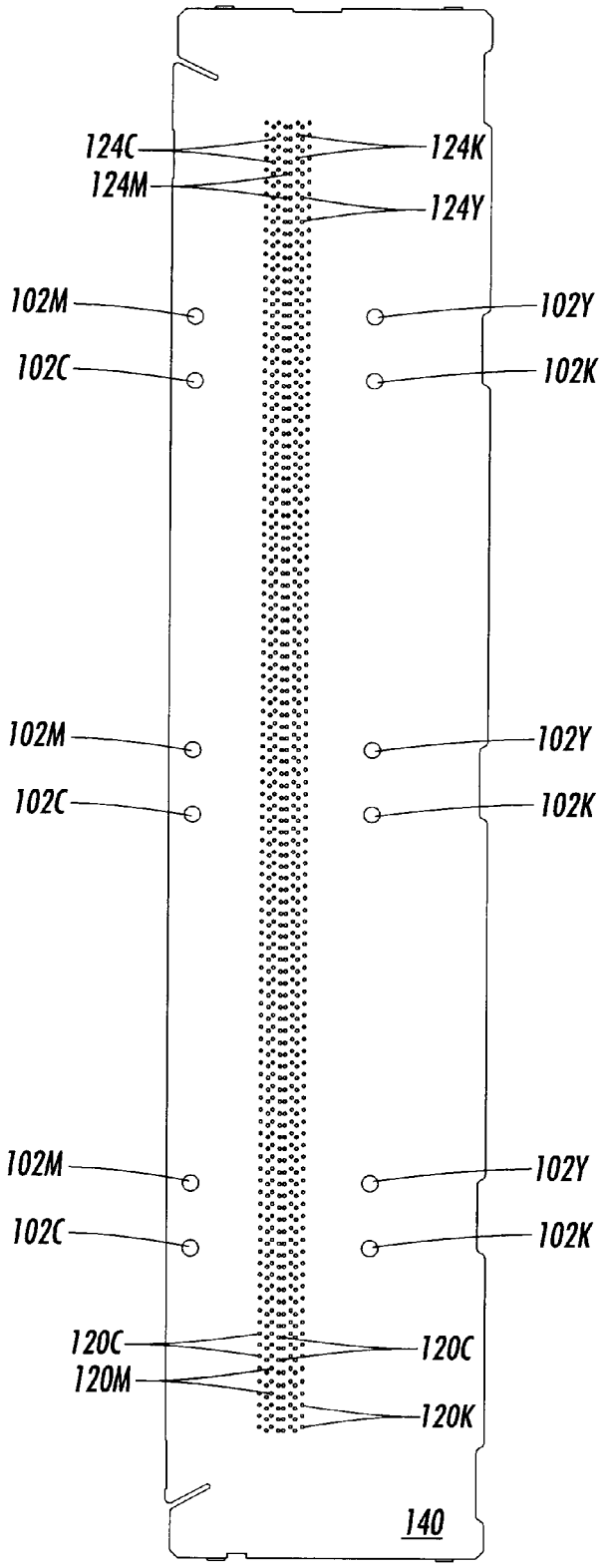
FIG. 15 is a plan view showing a preferred separator plate of this invention.

FIG. 15 shows separator plate 140, through which are openings for forming portions of outlet ports 124 and portions of ink inlet ports 102.

Figure 16:
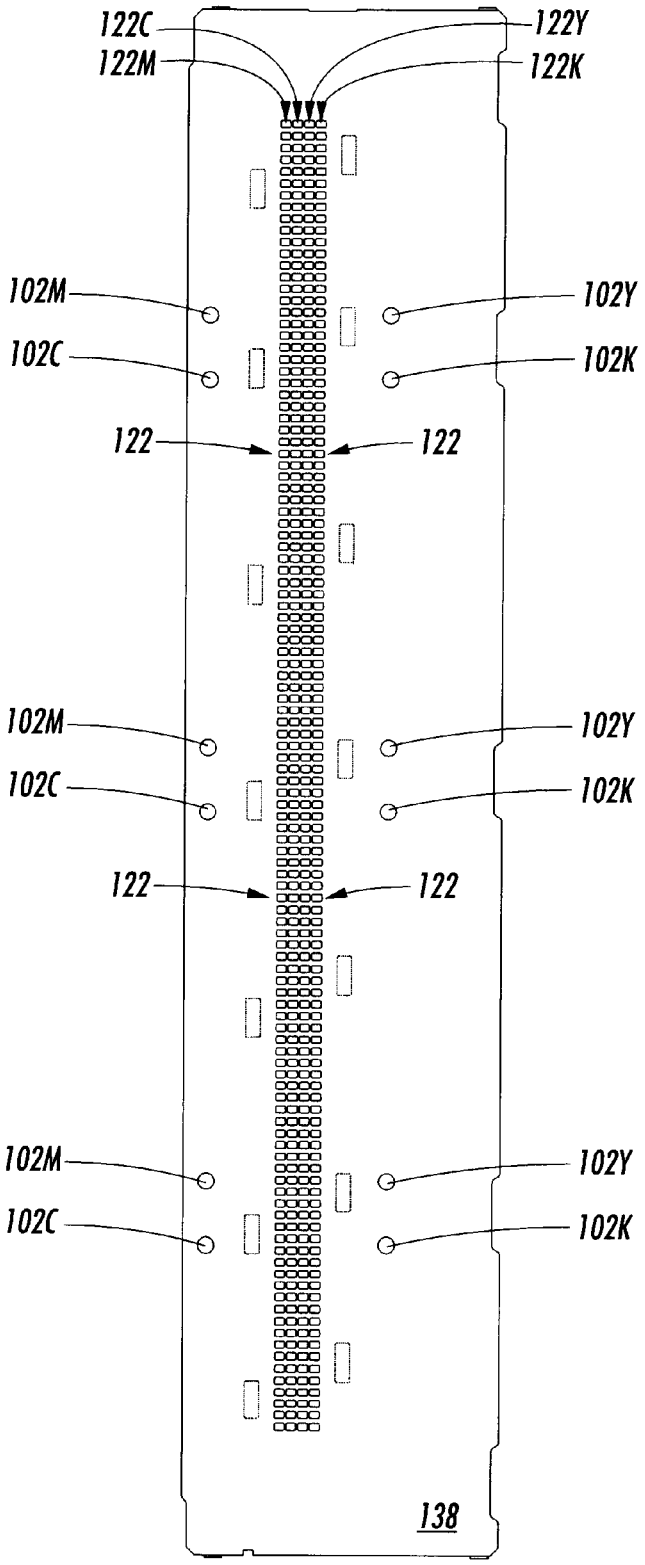
FIG. 16 is a plan view showing a preferred body plate of this invention.

FIG. 16 shows body plate 138, through which are openings for forming portions of ink pressure chambers 122 and portions of ink inlet ports 102.

Figure 17:
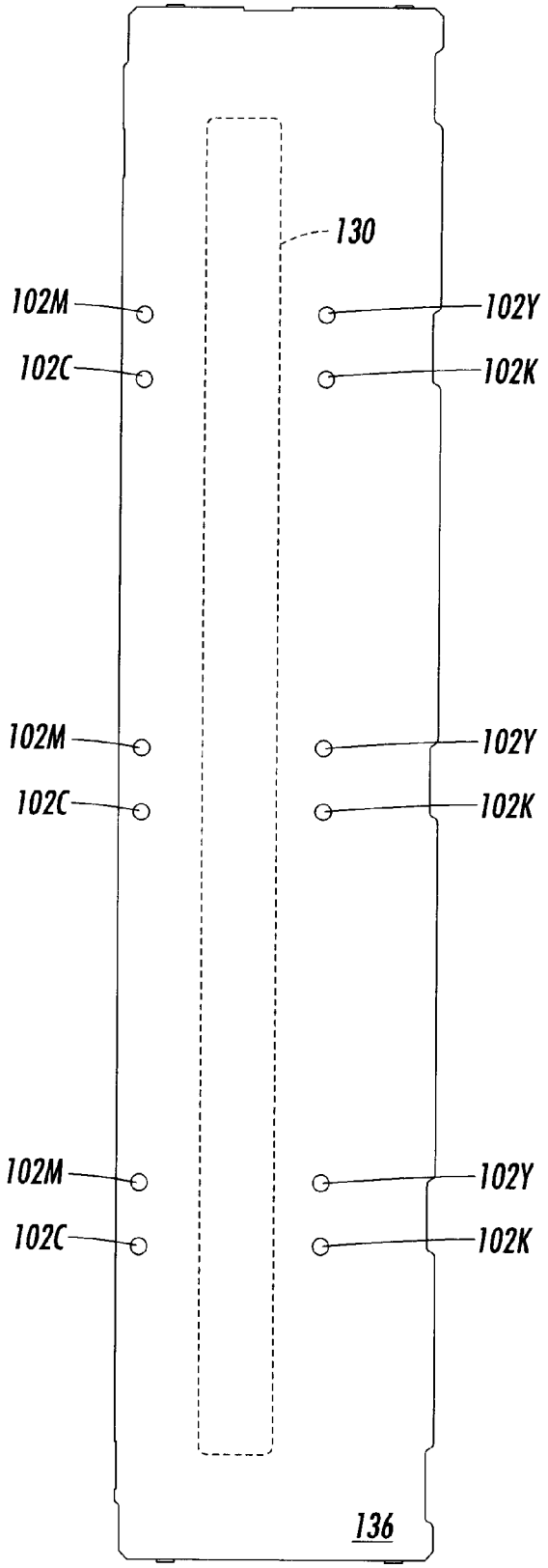
FIG. 17 is a plan view showing a preferred diaphragm plate of this invention.

FIG. 17 shows diaphragm plate 136, through which are openings for forming portions of ink inlet ports 102. Diaphragms 130 are inherently formed in the plate material in the region shown outlined in dashed lines.

To minimize pressure fluctuations in manifolds 106, compliant walls 150 form one wall along the entire length of manifolds 106. The mechanical compliance of walls 150 absorbs the ink pressure fluctuations during the "start-up" of jet firing and until a steady ink flow is established. An electrical analogy to compliant walls 150 is a filter capacitor in a power supply.

Referring to FIGS. 6–12, ink supply performance of manifolds 106 is further enhanced by providing three ink feed channels 104 per manifold to reduce the fluidic inductance (resistance to ink flow) within manifolds 106. Providing three ink feed channels 104 per manifold 106 is electrically analogous to placing three resistors in parallel. That is, the effective manifold length is one-sixth the actual manifold length and the manifold inductance is reduced accordingly.

Figure 18:
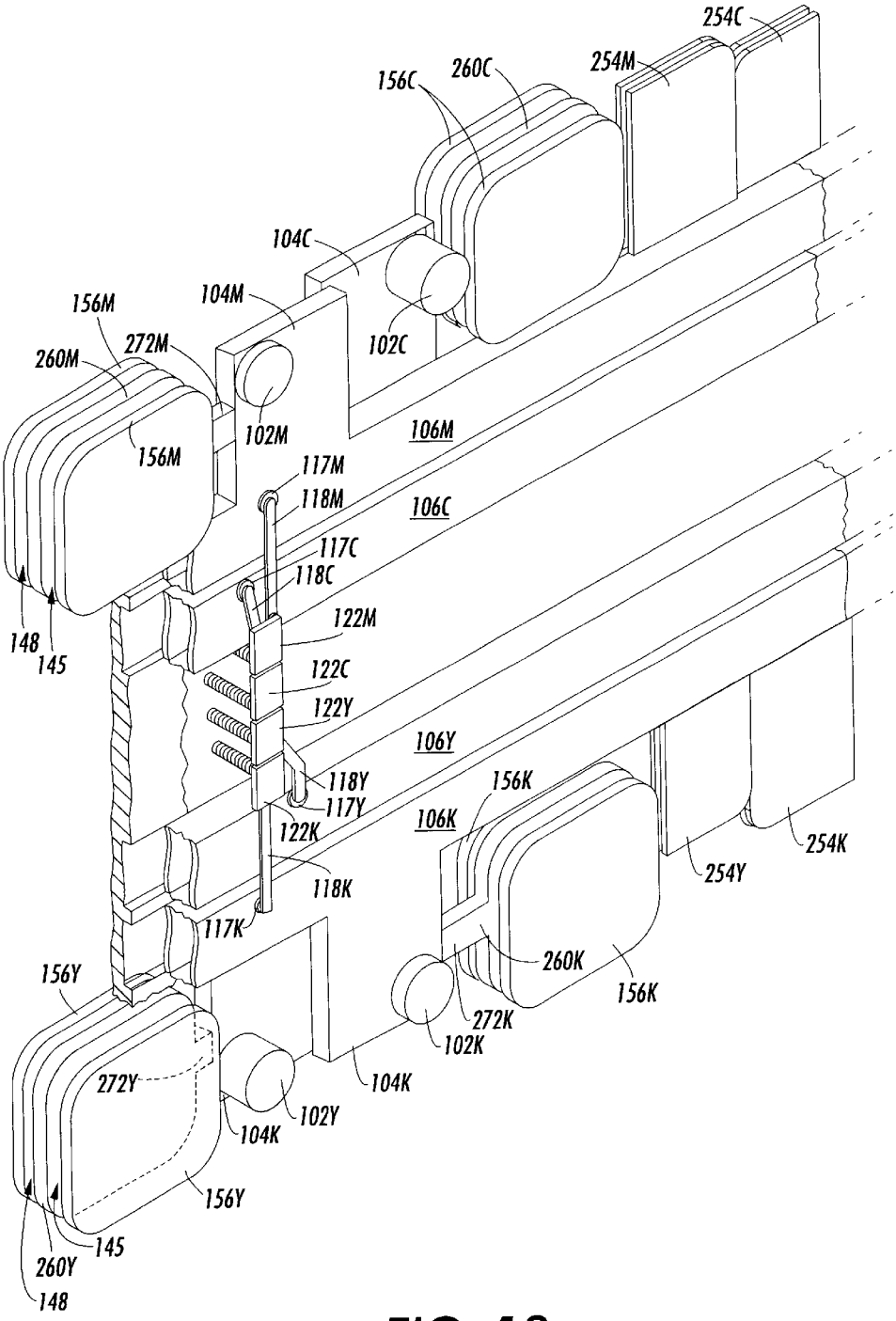
FIG. 18 is an enlarged diagrammatical isometric view of four adjacent ink jets of this invention shown partly cut away to reveal ink feed and ink manifold design details.

Referring to FIG. 18, there is shown an enlarged diagrammatical isometric view of four adjacent ink jets of this invention shown partly cut away to reveal ink feed, ink manifold, acoustic filters, boost bottle and ink feed chamber with acoustic filter constriction design details. Ink feeds into the print head via holes 102 in the ink feed channels 270, which are rectangular spaces measuring approximately 240 mils wide by 398 mils tall by 40 mils deep. These ink feed channels 270 have compliant walls 150 on one side. Attached to the ink feed channels 270 is an aperture 272 referred to as an acoustic filter constriction which acts as resistive element measuring approximately 15 mils wide by 150 mils tall by 24 mils deep. Attached on the other side of aperture 272 is the boost bottle filter 260 measuring approximately 320 mils wide by 288 mils tall by 40 mils deep.

As shown, the acoustic filters 254 are positioned along the manifold length 106. These acoustic filters 254 measure approximately 240 mil by 280 mil by 8 mil deep with one compliant wall. The acoustic filters 254 act as large capacitors connected directly to the manifold path 106, and thus act as a low pass filter and attenuate the higher frequency fluidic resonances. These filters are placed along the manifold length to be directly in between each port or manifold end. This has a twofold effect, first it cuts the effective length of the manifolds in half and second it cuts the jetting load for each segment in half. This filter characteristic however is unable to attenuate low frequency resonances that occur due to larger segments in the ink supply system. Because this filter is unable to attenuate those frequencies the pressure fluctuations are passed on to the inlet of the individual jets. The drop mass of the individual jets are changed due to pressure fluctuations in the manifold. This results in degraded image quality.

The implementation of the boost bottle 260 is to behave as a high pass filter. As is well known in the art, the impedance of a high pass filter becomes infinite at high frequencies. In accordance with the present invention fluid paths having inductance and resistance are defined. As shown in FIG. 18 and defined in the ink stack of drawings 3 through 17, a nominal compliant wall system or ink feed 270 connected to an acoustic filter constriction 272 connected to boost bottle 260, in addition to acoustic filters 254, with compliant wall systems is utilized to suppress the unwanted frequencies associated with print modes. The boost bottle 260 has compliant walls on both sides. This is done to maximize compliance. One advantage of the present invention is that the pressure fluctuations that occur in the manifold have two paths they can follow. The fluctuations can be taken up by the ink feed capacitor ($C_{feed}$) which is tuned to remove higher frequency components. The pressure can also induce flow through the acoustic filter constriction 272 into the boost bottle 260. By going through the constriction, the flow is forced to go through a fluid resistance and inductance ($R_{const}$ and $L_{const}$ respectively). After passing through the constriction the pressure is absorbed by the boost bottle 260 capacitance. The constrictor/boost bottle combination creates a high pass filter. This has the ability to remove the low frequency resonance.

Skilled workers will recognize that portions of this invention may have alternative embodiments. For example, fluids other than phase-change ink may be employed and may consist of any combination of colors or just a single color, such as black. Likewise, the print head may have a width other than media-width and may employ a wide variety of orifice array configurations. Also, the ink jets may be driven by mechanisms other than the piezoelectric transducer described. Also, the number of compliant walls, and the position of the boost bottles, acoustic filter constriction, and acoustic filters may be varied. And, of course, fabrication processes other than laminated plate construction may be employed, and the various dimensions described may be altered dramatically to suit particular application requirements.

It will be obvious to those having skill in the art that many changes may be made to the details of the above-described embodiments of this invention without departing from the underlying principles thereof. Accordingly, it will be appreciated that this invention is also applicable to imaging applications other than those found in image transfer ink jet printers. The scope of the present invention should, therefore, be determined only by the following claims.

What is claimed is:

1. An ink jet print head comprising:

a plurality of operating plates held together in a superimposed relation forming said ink jet print head defining a plurality of ink manifolds, ink inlets, ink drop-forming orifices and a plurality of acoustic filters wherein said acoustic filters suppress unwanted frequencies during print modes said acoustic filters including a plurality of acoustic filters positioned along said ink manifolds and a plurality of boost bottles having at least two compliant walls each on one side acting as low pass filters and attenuating high frequency resonances of a plurality of jetting frequencies.

2. An ink jet print head comprising:

a plurality of operating plates held together in a superimposed relation forming said ink jet print head defining a plurality of ink manifolds, ink inlets, ink drop-forming orifices and a plurality of acoustic filters wherein said acoustic filters suppress unwanted frequencies during print modes said acoustic filters including a plurality of acoustic filters positioned along said ink manifolds and a plurality of boost bottles defined by at least two compliant walls each on one side and acting as low pass filters and attenuating high frequency resonances of a plurality of jetting frequencies.

3. The ink jet print head according to claim 2 further comprising:

said boost bottle filters measuring approximately 320 mils wide by 288 mils tall by 40 mils deep defined within said ink jet print head.

4. The ink jet print head according to claim 3 further comprising:

said boost bottle filters connected to a plurality of ink feed channels.

5. The ink jet print head according to claim 4 further comprising:

said ink feed channels having a compliant wall on one side.

6. The ink jet print head according to claim 5 further comprising:

said ink feed channels measuring approximately 240 mils wide by 398 mils tall by 40 mils deep within said ink jet print head.

7. The ink jet print head according to claim 6 further comprising:

each of said boost bottle filters and said ink feed channels connected by an aperture defined within said ink jet print head.

8. The ink jet print head according to claim 7 further comprising:

said aperture defining an acoustic filter constriction acting as a resistive element with said boost bottle filter for performing low frequency filter characteristics with said ink feed channel.

9. The ink jet print head according to claim 8 further comprising:

said plurality of acoustic filters including a plurality of acoustic filters positioned along said ink manifolds measuring approximately 240 mil by 280 mil by 8 mil deep having one compliant wall wherein said acoustic filters act as large capacitors connected directly to said ink manifold acting as a low pass filters and attenuating high frequency resonances of a plurality of jetting frequencies.

* * * * *